US006509570B1

(12) United States Patent
Hirokawa et al.

(10) Patent No.: US 6,509,570 B1
(45) Date of Patent: Jan. 21, 2003

(54) GALLIUM ION SOURCE

(75) Inventors: Shinpei Hirokawa, Gunma (JP); Katsuyoshi Tsunoda, Gunma (JP); Yoshinori Terui, Gunma (JP)

(73) Assignee: Denki Kagaku Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/478,401

(22) Filed: Jan. 6, 2000

(30) Foreign Application Priority Data

Jan. 7, 1999 (JP) ..... 11-002082

(51) Int. Cl.[7] ..... H01J 27/02
(52) U.S. Cl. ..... 250/423 R; 250/424
(58) Field of Search ..... 250/423 R, 424, 250/427

(56) References Cited

U.S. PATENT DOCUMENTS 4,488,045 A * 12/1984 Anazawa et al. ..... 250/423 R
5,825,035 A * 10/1998 Mizumura et al. ..... 250/423 R

FOREIGN PATENT DOCUMENTS

JP 54-105669 * 8/1979 ..... H05H/7/00
JP 56-168327 * 12/1981 ..... H01J/37/08
JP 58-35829 3/1983
JP 58-40744 3/1983
JP 60-105148 6/1985
JP 61-29041 2/1986
JP 02-018837 * 1/1990 ..... H01J/27/26
JP 6-3326 1/1994
JP 10-92362 4/1998

* cited by examiner

*Primary Examiner*—John R. Lee
*Assistant Examiner*—Anthony Quash
(74) *Attorney, Agent, or Firm*—Oblon, Spivak, McClelland, Maier & Neustadt, P.C.

(57) ABSTRACT

A gallium ion source including a needle electrode, a reservoir for storing gallium, and a wire heater for heating the needle electrode and the reservoir. The needle electrode, the reservoir and the gallium stored in the reservoir have total heat capacity of not less than 0.015 J/K and not higher than 0.1 J/K. The needle electrode and reservoir of the gallium ion source may have a total heat capacity of 0.015 J/K to 0.1K and the initial amount of gallium is 0.004–0.10 g, The wire heater may have a diameter of 0.10–0.20 mm and a length of 8–30 mm, and may be in a V shape with a bend angle of 40°–90°.

9 Claims, 2 Drawing Sheets

GALLIUM ION SOURCE

BACKGROUND OF THE INVENTION

1. Field of the Invention

The present invention relates to a gallium ion source, which is used in a focused ion beam system, such as a section specimen preparation apparatus for mask repair, a scanning ion microscope and a transmission electron microscope, and an ion beam etching system for section formation used in a semiconductor inspection apparatus.

2. Discussion of Background

Gallium ion sources that have been industrially used at present comprise a needle electrode having a tip provided with a sharp edge, a reservoir for storing gallium, a heater for heating the needle electrode and the reservoir by Joule heating, and supporting terminals for attaching the needle electrode, the reservoir and heater to an insulating ceramic base. In the known gallium ion sources, the needle electrode and the heater are made of tungsten wires, and the needle electrode and the heater are jointed by spot-welding.

With regard to the operational conditions of the gallium ion sources, it is reportedly preferable that the gallium ion sources are operated at a low emission current and at a low temperature to minimize the energy distribution spread of emitted ions so as to make the beam diameter smaller, which is stated in J. Appl. Phys., 51, 3453–3455 (1980).

Gallium can easily keep a liquid state at a temperature near room temperature since the melting point of gallium is 29.8° C. and since gallium can easily keep a supercooling state. From this viewpoint, the operation at room temperature has been dominant in the gallium ion sources. However, when the operation is continued at room temperature, it becomes impossible to carry out stable ion emission since the surface of gallium is contaminated by residual gases in a vacuum and sputtered metals from electrodes, as a result of disturbing the feed of gallium from the reservoir to the tip of needle electrode through side surfaces of the needle electrode.

In order to recover the stable ion emission from an unstable gallium feed, an operation, so called flashing, is carried out to temporarily raise the temperatures of the reservoir, the needle electrode and the gallium to about 600° C. or higher so as to evaporate contamination for cleaning. The flashing operation is normally carried out about once in 50 hr when the gallium ion sources are operated under an operational vacuum circumstance of about $1\times10^{-7}$ Torr, which is a typical operational circumstance. The life of the gallium ion sources, which have been industrially used at present, is about 500–1,500 hr, and the life depends on the amount of the gallium stored in the reservoir and the evaporation amount of the gallium on flashing.

The flashing operation is carried out by means of feeding electrical current into the heater or applying voltage across the heater for a certain period of time to obtain a desired temperature, referring to preliminarily determined current or voltage, which raises the temperature of the reservoir to 600–800° C.

However, the gallium ion sources, which have been industrially used at present, have the life shortened for the reasons stated below when the gallium ion sources are subjected to the flashing operation at a constant certain current or voltage from the initial stage in use. Referring now to FIG. 3, there are shown changes in the temperature of the reservoir with time with respect to commercially available gallium ion sources having different remaining amounts of gallium, at the same current value. When the current value on flashing is constant, and when the flashing operation is carried out for a short period of time (for example, the period of time indicated by A in FIG. 3), the evaporation amount of the gallium increases to extraordinarily shorten the life of the gallium ion sources since the maximum temperature on flashing is raised with consumption of the gallium. Even when the period of time for flashing is set at the value indicated by B in FIG. 3, there is created a problem in that the evaporation amount of the gallium in each flashing operation becomes extremely great to shorten the life of the gallium ion sources due to a rapid consumption of the stored gallium since the reservoir temperature is kept high during most of the period for flashing. It has been proposed that the fed current, the applied voltage or the period of time on flashing be varied, depending on the remaining amount of the gallium, so as to avoid these phenomena for preventing the consumption of the gallium. However, the proposal has not provided sufficient improvement since it is practically difficult to estimate the remaining amount of the gallium properly. There is a great demand for a gallium ion source having stable flashing characteristics and stable life in terms of both ease in operation and high-availability of above-mentioned equipment utilizing gallium ion source.

SUMMARY OF THE INVENTION

It is an object of the present invention to provide a gallium ion source operated at a low temperature, capable of carrying out a flashing operation without changing a current or a voltage supplied to a heater, or a period of time for flashing operation, depending on the remaining amount of the gallium, for a flashing operation required to obtain stable ion emission, and consequently, to realize highly improved ease in operation and availability of equipment utilizing gallium ion source.

The inventors have conducted various experimental researches to find a solution for the object. The inventors have attained the present invention, finding that the phenomena stated earlier occur because the rate of the heat capacity of the gallium to the total heat capacity of the reservoir, the needle electrode and the gallium as heated portions in the ion source is great, and because the consumption of the gallium brings about a decrease in the heat capacity of the heated portions in the ion source, and hence to decrease the amount of heat required to bring the temperature of the heated portions to a steady state on flashing.

The present invention provides a gallium ion source comprising a needle electrode, a reservoir for storing gallium, and a wire heater for heating the needle electrode and the reservoir, wherein the needle electrode, the reservoir and the gallium stored in the reservoir have total heat capacity of not less than 0.015 J/K and not higher than 0.1 J/K. It is preferable that the needle electrode and the reservoir have total heat capacity of 0.01–0.099 J/K, that the gallium has an initial amount of 0.004–0.10 g, that the wire heater has a diameter of 0.10–0.20 mm and a length of 8–30 mm, and that the wire heater is formed in a V character shape so as to be bent at an angle of 40–90°. In the gallium ion source having such a specific range of heat capacity, the reservoir may comprise a coiled metallic wire provided in at least a dual structure. In the present invention, the heat capacity is in the specific range, and the needle electrode, the wire heater and the reservoir may be made of any material. However, it is preferable that the needle electrode, the wire heater and the reservoir are made of metal, such as tungsten and a tungsten-rhenium alloy, in terms of wettability and reactivity with gallium.

The present invention also provides a gallium ion source comprising a needle electrode, a reservoir for storing gallium, and a heater for heating the needle electrode and the reservoir and for sandwiching the reservoir therebetween, wherein the needle electrode, the reservoir and the gallium stored in the reservoir have total heat capacity of not less than 0.035 J/K and not higher than 0.1 J/K. It is preferable that the needle electrode and the reservoir have total heat capacity of 0.02–0.099 J/K, or that the gallium has an initial amount of 0.004–0.10 g.

The gallium ion source according to the present invention is useful to highly improve ease in operation and availability of equipment utilizing gallium ion source since the gallium ion source according to the present invention can minimize variations in the life without changing the heater current, the heater voltage or the period of time on flashing, depending on the remaining amount of the gallium and since the gallium ion source can provide a gallium ion beam having a long life.

BRIEF DESCRIPTION OF THE DRAWINGS

In a more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
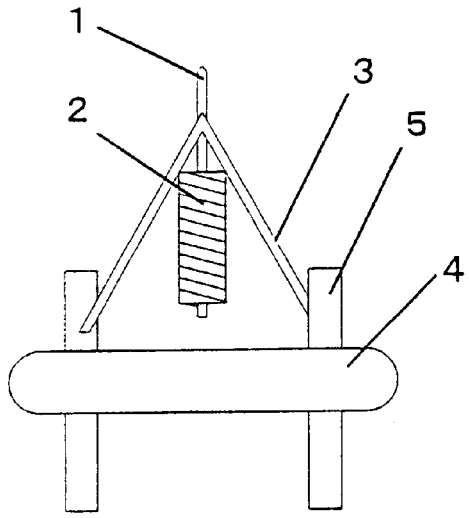
FIG. 1 is a schematic view of the gallium ion source assembly according to a first example and a third example of the present invention.

The essential features of the present invention are that the sum of the heat capacity of each of a needle electrode, a reservoir and gallium stored in the reservoir, which form a gallium ion source, (hereinbelow, referred to as the total heat capacity as well) is in a specific range, and that the total heat capacity is not less than 0.015 J/K and not higher than 0.1 J/K when the gallium ion source comprises the needle electrode, the reservoir with the gallium stored therein and a wire heater for heating the needle electrode and the reservoir, and that the total heat capacity is not less than 0.035 J/K and not higher than 0.1 J/K when the gallium ion source comprises the needle electrode, the reservoir with the gallium stored therein and a heater for heating the needle electrode and the reservoir and for sandwiching the reservoir therebetween. The gallium ion source that meets these requirements can offer advantages in that even if the remaining amount of the gallium changes by actual use of the gallium ion source, the gallium ion source can have flashing characteristics that are not significantly affected by the change in the remaining amount, that flashing conditions are not required to be changed in repeated flashing operations, and that the undesired consumption of the gallium on flashing, which has occurred in the conventional gallium ion sources, can be prevented to provide the gallium ion source with a long life.

First, the wire heater type gallium ion source will be explained.

When the total heat capacity is less than 0.015 J/K, it is difficult for the gallium ion source to have a long life as the object of the present invention. This is because the consumption of the gallium causes the heat capacity of the heated portions in the ion source to be decreased, because whenever the flashing operation is repeated, the temperature of the heated portions is gradually raised due to the decrease in the heat capacity of the heated portions, and because the gallium can not be prevented from consumption due to the increased temperature of the heated portions. On the other hand, when the total heat capacity is higher than 0.1 J/K, there could be occurred an inconvenient phenomenon in that the amount of heat used in flashing becomes too great to neglect variations in the geometrical dimensions between a peripheral electrode member and the needle electrode due to thermal expansion by radiant heat, causing variations in ion emission characteristics, or that it takes long for the ion emission characteristics to be brought into a steady state since it takes some time to cool the heated portions to room temperature.

When the sum of the heat capacity of the needle electrode and the heat capacity of the reservoir is 0.01–0.099 J/K, a change in the total heat capacity in use can be minimized to attain the object of the present invention in better fashion.

When the gallium has an initial gallium amount (the amount of the gallium when the gallium ion source is initially put into actual use) is 0.004–0.10 g, similar advantages can be offered.

As the wire heater, metal having a high melting point, such as tungsten and a tungsten-rhenium alloy, or other material can be generally used. Since the needle electrode, the reservoir and the gallium having a total heat capacity in the specific range are heated to a target temperature, the wire heater preferably has a diameter of 0.10–0.20 mm and a length of 8–30 mm if the wire heater is made of tungsten. The wire heater is preferably formed in a V character shape since a geometrical change can be minimized in operation of the gallium ion source.

Particularly preferably, the reservoir for storing gallium comprises a coiled wire, and the coiled wire is provided in a coil of, at least, two turns since it is easy to attain heat capacity in the specific range.

Next, the gallium ion source that includes a heater for sandwiching the reservoir therebetween will be explained.

In the case of this type of gallium ion source, the experimental consideration by the inventors shows that when the sum of the heat capacity of each of the needle electrode, the reservoir and the gallium is not less than 0.035 J/K and not higher than 0.1 J/K, the object of the present invention can be attained. When the total heat capacity is less than 0.035 J/K, it is difficult for the gallium ion source to have a long life as the object of the present invention. This is because the consumption of the gallium causes the heat capacity of the heated portions in the ion source to be decreased, because whenever the flashing operation is repeated, the temperature of the heated portions is gradually raised due to the decrease in the heat capacity of the heated portions, and because the gallium can not be prevented from consumption due to the increased temperature of the heated portions. On the other hand, when the total heat capacity is higher than 0.1 J/K, there could be occurred an inconvenient phenomenon in that the amount of heat used in flashing becomes too great to neglect variations in the geometrical dimensions between a peripheral electrode member and the needle electrode due to thermal expansion by radiant heat, causing variations in ion emission characteristics, or that it takes long for the ion emission characteristics to be brought into a steady state since it takes some time to cool the heated portions to room temperature.

In order to advantageously attain the object of the present invention in this type of gallium ion source, it is preferable that the sum of the heat capacity of each of the needle electrode and the reservoir is 0.02–0.099 J/K, and it is preferable that the gallium has an initial amount of 0.004–0.10 g.

Figure 2:
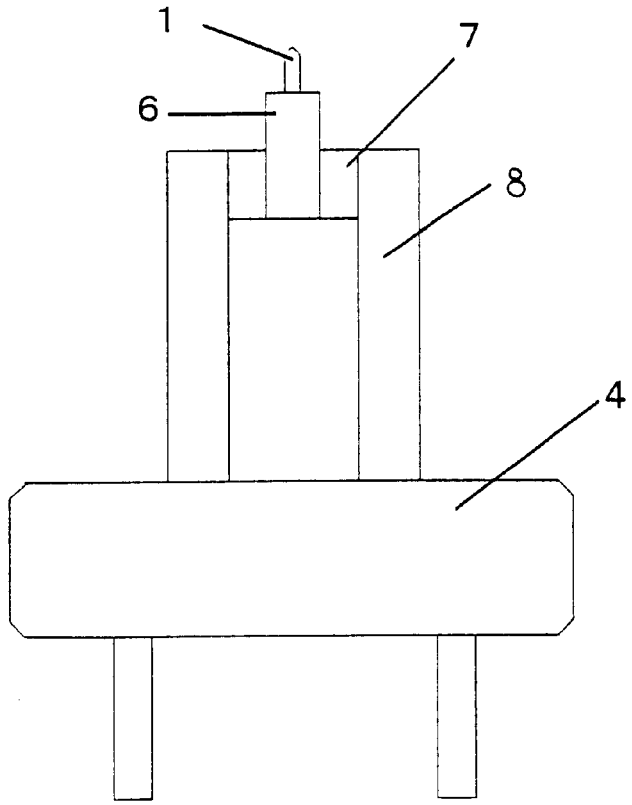
FIG. 2 is a schematic view of the gallium ion source assembly according to a second example and a fourth example of the present invention.
Figure 3:
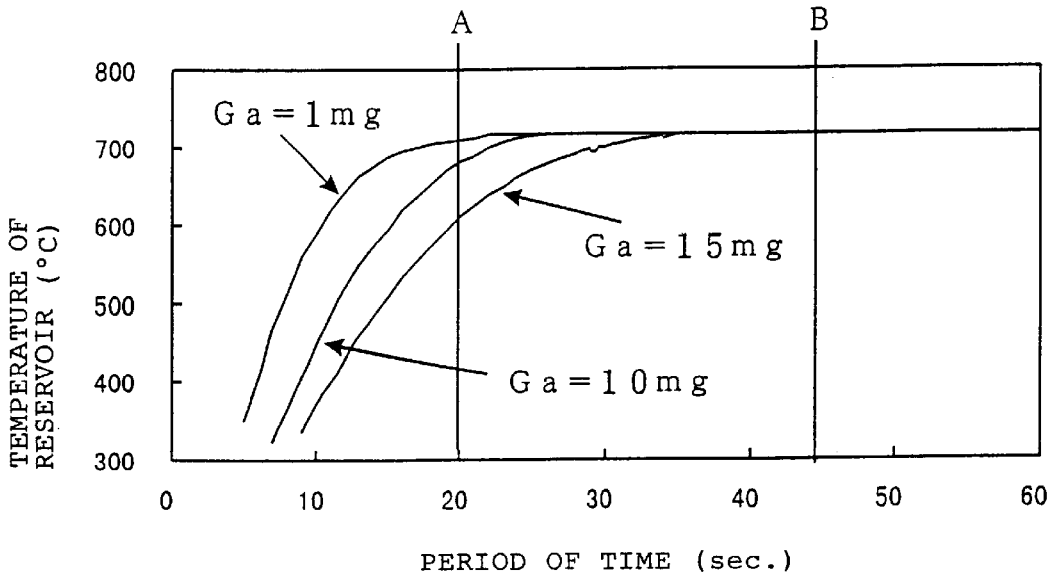
FIG. 3 is a graph to explain changes in the temperature of a reservoir with time (a heat current having the same value is applied), wherein the remaining amounts of gallium in a commercially available gallium ion source were changed.

Examples of the gallium ion source according to the present invention will be described in detail, referring to FIGS. 1 and 2. The gallium ion source shown in FIG. 1 has such an arrangement that a coiled wire is provided in a dual structure to form a reservoir 2, the reservoir 2 is formed integrally with a needle electrode 1, the needle electrode 1 has a portion spot-welded to a wire heater 3, and the wire heater 3 has both ends spot-welded to supporting terminals 5 attached to an insulating ceramic base 4. The gallium ion source shown in FIG. 2 has such an arrangement that a reservoir 6 is formed in a cylindrical shape, the reservoir has a bottom spot-welded to a needle electrode 1, the reservoir 6 is sandwiched between heaters 7 made of graphite or other material, the heaters are held by metallic holders 8, and the holders are attached to an insulator 4.

In accordance with the present invention, the sum of the heat capacity of each of the needle electrode 1, the reservoir 2 or 6 and the gallium is in the specific range as stated earlier. The heat capacity can be easily calculated by measuring the weight of the respective parts and multiplying the weight of the respective parts by the mean specific heat of the constituent material of the respective parts at a temperature near 600–800° C.

With respect to the gallium used in the present invention, any gallium is acceptable as long as it can provide a gallium ion beam at room temperature. For example, not only commercially available gallium of 99% purity or more but also an alloy including gallium as the main component and an added component, such as indium, may be acceptable.

Now, the present invention will be described in detail, referring to Examples and Comparative Examples.

EXAMPLE 1

A commercially available tungsten wire having a diameter of 0.15 mm was coiled in a dual structure to form the reservoir 2. The reservoir 2 and the needle electrode 1 made of tungsten were spot-welded to the wire heater 3 made of tungsten to fabricate the gallium ion source assembly shown in FIG. 1. The reservoir 2 was sized so that the sum of the heat capacity of the needle electrode 1 and that of the reservoir 2 was 0.024 J/K. The wire heater was formed from a wire having a diameter of 0.15 mm so as to have a shape with a central portion bent at an angle of 60°.

The gallium ion source assembly was placed in a vacuum system having a crucible with gallium preliminarily filled therein. Under a pressure of $7\times10^{-7}$ Torr or less, the gallium was heated along with the crucible, and the needle electrode and the reservoir were dipped into the gallium in the crucible while feeding electrical current into the heater of the gallium ion source assembly to heat the needle electrode and the reservoir. By dipping the needle electrode and the reservoir into the gallium, the surfaces of the needle electrode were wetted by gallium and the gallium was filled in the reservoir to provide the gallium ion source. At that time, the electrical current value of heater that increased the temperature of the reservoir filled with gallium to 750° C. was measured as the current value for flashing.

The weight of the filled gallium was 0.015 g, and the sum of the heat capacity of each of the needle electrode, the reservoir and the gallium was 0.030 J/K. According to the first example, totally five gallium ion sources were fabricated in this way, and the life of each of the gallium ion sources was measured by the following method.

The gallium ion sources thus fabricated were mounted on a focused ion beam system in turn, and the needle electrode of each of the gallium ion sources has a tip of needle electrode put under a strong electric field to emit an ion beam (emission current) having 2 $\mu$A. The applied voltage was about 6 kV. When the applied voltage increased by more than 5%, flashing was carried out to recover required emission characteristics. The total period of time where the emission current stated earlier was able to be obtained was measured, and the total period of time thus measured was determined as a life. Flashing was carried out by supplying a preset current value (required to increase the temperature of the reservoir to 750° C.) for 45 sec with use of a constant current power supply. According to the measurement, the longest life was 1,415 hr, the shortest life was 1,209 hr and the average life was 1,317 hr with respect to the five gallium ion sources. The results of the measurement are shown in Table 1.

TABLE 1

| | Number of gallium ion sources for evaluation | Total heat capacity of needle electrode, reservoir and gallium (J/K) | Initial gallium amount (g) | Averge life (hr) | Longest life (hr) | Shortest life (hr) |
|---|---|---|---|---|---|---|
| Example 1 | 5 | 0.03 | 0.015 | 1,317 | 1,415 | 1,209 |
| Example 2 | 5 | 0.04 | 0.015 | 1,323 | 1,420 | 1,201 |
| Example 3 | 5 | 0.03 | 0.025 | 1,509 | 1,590 | 1,403 |
| Example 4 | 5 | 0.04 | 0.025 | 2,011 | 2,105 | 1,870 |
| Comparative Example 1 | 5 | 0.01 | 0.015 | 410 | 525 | 285 |
| Comparative Example 2 | 5 | 0.01 | 0.015 | 630 | 1,290 | 196 |

EXAMPLE 2

The cylindrical reservoir was fabricated from a tantalum sheet having a thickness of 0.4 mm. Next, a flat plate, which was cut out from a tantalum sheet having a thickness 0.3 mm, had a central portion drilled, and the flat plate was fixed to an end of the cylindrical reservoir in a direction perpendicular to the centerline of the cylindrical reservoir. The needle electrode 1, which had a diameter of 0.15 mm, and which was made of tungsten wire and independently prepared, was attached to the drilled aperture of the tantalum flat plate to fabricate the reservoir 6 having a lower open end and the needle electrode 1. The needle electrode 1, the reservoir 6 and the flat plate were sized to have a total heat capacity of 0.034 J/K.

The reservoir 6 had a lower portion sandwiched between carbon heaters 7, and the entire structure of the reservoir 6 and the heaters 7 were held by metallic holders 8 fixed to an insulating ceramic base 4 to fabricate a gallium ion source assembly.

The gallium ion source assembly was dipped into gallium by the same operation as Example 1. The weight of the filled gallium was 0.015 g, and the sum of the heat capacity of each of the needle electrode, the reservoir and the gallium was 0.040 J/K. According to this example, totally five gallium ion source assemblies were fabricated and the life of each of the gallium ion sources was measured in the same method as Example 1. According to the measurement, the longest life was 1,420 hr, the shortest life was 1,201 hr, and the average life was 1,323 hr.

EXAMPLE 3

Five gallium ion source assemblies were fabricated according to the same operation as Example 1 except that the needle electrode and the reservoir were sized to have total heat capacity of 0.021 J/K.

The gallium ion source assemblies were dipped into gallium by the same operation as Example 1. The weight of the filled gallium was 0.025 g, and the sum of the heat capacity of each of the needle electrode, the reservoir and the gallium was 0.030 J/K. The life of each of the gallium ion sources was measured in the same method as Example 1. According to the measurement, the longest life was 1,590 hr, the shortest life was 1,403 hr, and the average life was 1,509 hr.

EXAMPLE 4

Five gallium ion source assemblies were fabricated according to the same operation as Example 2 except that the needle electrode, the reservoir and the flat plate were sized to have total heat capacity of 0.031 J/K.

The gallium ion source assemblies were dipped into gallium by the same operation as Example 1. The weight of the filled gallium was 0.025 g, and the sum of the heat capacity of each of the needle electrode, the reservoir and the gallium was 0.040 J/K. The life of each of the gallium ion sources was measured in the same method as Example 1. According to the measurement, the longest life was 2,105 hr, the shortest life was 1,870 hr, and the average life was 2,011 hr, which shows that the gallium ion sources had the life significantly improved.

Comparative Example 1

Ten gallium ion source assemblies, each of which comprised a commercially available tungsten wire having a diameter 0.15 mm and coiled in a single structure to provide a reservoir for gallium so that the sum of the heat capacity of a needle electrode and that of the reservoir was 0.004 J/K, were fabricated by the same operation as Example 1.

The gallium ion source assembles were dipped into gallium by the same operation as Example 1. The weight of the filled gallium was 0.015 g, the sum of the heat capacity of each of the needle electrode, the reservoir and the gallium was 0.010 J/K. The life of five of the gallium ion sources according to this Comparative Example was measured in the same method as Example 1. According to the measurement, the longest life was 525 hr, the shortest life was 285 hr and the average life was 410 hr though the gallium was filled at the same amount as Example 1.

Comparative Example 2

With respect to the remaining five gallium ion sources fabricated according to Comparative Example 1, an attempt was made to restrain the gallium from over consumption by decreasing the supplied heating current on flashing with operating time of gallium ion source. Specifically, the relationship between proper supplied heating current values and operating time was preliminarily researched by measuring the heating characteristics with respect to one of the ion source on every flashing. Based on the researched relationship, the life of the remaining five gallium ion sources was measured. According to the measurement, the longest life was about 1,300 hr, and the shortest life was about 200 hr, which shows that variations in lives widely spread.

Obviously, numerous modifications and variations of the present invention are possible in light of the above teachings. It is therefore to be understood that within the scope of the appended claims, the invention may be practiced otherwise than as specifically described herein.

What is claimed is:

1. A gallium ion source comprising:

a needle electrode;

a reservoir for storing gallium; and a wire heater for heating the needle electrode and the reservoir;

wherein the needle electrode, the reservoir and the gallium stored in the reservoir have total heat capacity of not less than 0.015 J/K and not higher than 0.1 J/K.

2. The gallium ion source according to claim 1, wherein the needle electrode and the reservoir have total heat capacity of 0.01–0.099 J/K.

3. The gallium ion source according to claim 2, wherein the gallium has an initial amount of 0.004–0.10 g.

4. The gallium ion source according to claim 3, wherein the wire heater has a diameter of 0.10–0.20 mm and a length of 8–30 mm.

5. The gallium ion source according to claim 4, wherein the wire heater is formed in a V character shape so as to be bent at an angle of 40–90°.

6. The gallium ion source according to claim 1, wherein the reservoir comprises a coiled wire, and the coiled wire is provided in a coil of, at least, two turns.

7. A gallium ion source comprising:

a needle electrode;

a reservoir for storing gallium; and a heater for heating the needle electrode and the reservoir, and for sandwiching the reservoir therebetween;

wherein the needle electrode, the reservoir and the gallium stored in the reservoir have total heat capacity of not less than 0.035 J/K and not higher than 0.1 J/K.

8. The gallium ion source according to claim 7, wherein the needle electrode and the reservoir have total heat capacity of 0.02–0.099 J/K.

9. The gallium ion source according to claim 8, wherein the gallium has an initial amount of 0.004–0.10 g.

* * * * *